US006469625B1

(12) United States Patent
Tomooka

(10) Patent No.: US 6,469,625 B1
(45) Date of Patent: Oct. 22, 2002

(54) SECURITY SENSOR HAVING DISTURBANCE DETECTING CAPABILITY

(75) Inventor: Hiroyuki Tomooka, Otsu (JP)

(73) Assignee: Optex Co., LTD, Shiga (JP)

( * ) Notice: Subject to any disclaimer, the term of this patent is extended or adjusted under 35 U.S.C. 154(b) by 0 days.

(21) Appl. No.: 09/777,806

(22) Filed: Feb. 6, 2001

(30) Foreign Application Priority Data

Feb. 18, 2000 (JP) ..... 2000-040701

(51) Int. Cl.[7] ..... G08B 13/18

(52) U.S. Cl. ..... 340/556; 340/552; 340/551; 340/555; 340/545.3; 340/565; 340/567; 250/342; 250/341

(58) Field of Search ..... 340/556, 555, 340/552, 551, 541, 545.3, 561, 565, 567; 250/342, 341, 341.8, DIG. 1

(56) References Cited

U.S. PATENT DOCUMENTS

| | | | | | |
|---|---|---|---|---|---|
| 4,982,094 | A | * | 1/1991 | Matsuda | 340/567 |
| 5,243,326 | A | * | 9/1993 | Disabato | 340/555 |
| 5,489,892 | A | * | 2/1996 | Imuro et al. | 340/567 |
| 5,831,529 | A | * | 11/1998 | Pantus | 340/555 |
| 5,942,976 | A | * | 8/1999 | Wieser et al. | 340/565 |

FOREIGN PATENT DOCUMENTS

| | | | | |
|---|---|---|---|---|
| EP | 1126430 | | | 8/2001 |
| JP | 2287278 | | | 11/1990 |
| JP | 11096467 | A | * | 9/1997 |
| JP | 11250362 | A | * | 2/1998 |
| JP | 410334353 | A | * | 12/1998 |
| JP | 11086152 | A | * | 3/1999 |

* cited by examiner

*Primary Examiner*—Jeffery Hofsass
*Assistant Examiner*—Daniel Previl
(74) *Attorney, Agent, or Firm*—Price and Gess

(57) ABSTRACT

A security sensor 1 having a disturbance detecting capability capable of detecting the presence of an obstacle 8 purposefully applied to the sensor 1 in an attempt to fool or tamper the sensor 1 includes a carrier body A having an infrared sensor element 4, an incident side enclosure 5, such as a lens defining a detection area B, mounted on the carrier body A, a light projecting element 11 for projecting a disturbance detecting beam L1 from inside of the incident side enclosure 5 towards the incident side enclosure 5, a light receiving element 12 for receiving the disturbance detecting beam L1 reflected from the incident side enclosure 5, and a detecting circuit 15 for detecting a presence or absence of the obstacle 8 on the incident side enclosure 5, based on an amount of light received by the light receiving element 12. A multiplicity of projections 7 are formed on an outer surface of the incident side enclosure 5 so as to define a multiplicity of gaps between the obstacle 8 and the outer surface of the incident side enclosure 5, when the obstacle 8 is applied to the outer surface of the incident side enclosure 5.

13 Claims, 5 Drawing Sheets

SECURITY SENSOR HAVING DISTURBANCE DETECTING CAPABILITY

BACKGROUND OF THE INVENTION

1. Field of the Invention

The present invention generally relates to a security sensor of a type utilizing a passive-type infrared sensor element and, more particularly, to the security sensor of a type having a disturbance detecting capability for detecting the presence or absence of an obstacle such as, for example, a sticker or label affixed to the sensor casing to disable the security sensor.

2. Description of the Prior Art

An intruder detecting system utilizing the security sensor of the type referred to above is so designed and so configured as to detect an intruder within a detection area or a detection area in reference to the difference between the temperature of a human body and the ambient temperature when the passive-type infrared sensor element receives far infrared rays of light emitted from the human body within the detection area.

It has often been experienced that the intruder detecting system is tampered with an obstacle such as, for example, a transparent sticker or label of a kind capable of transmitting therethrough rays of light ranging from a visible wavelength region to a near infrared wavelength region, but intercepting far infrared rays of light, so that the intruder detecting system may be fooled enough to allow an intruder to trespass on the detection area monitored by the passive-type infrared sensor element. For example, while the intruder detecting system is held inoperative because the detection area is crowded with people moving in and out of the detection area, a potential intruder may enter the detection area and then affixes the obstacle to a light receiving enclosure or an incident side enclosure such as, for example, a sensor lens or cover through which the far infrared rays of light enter, so that the potential intruder can enter again the detection area later while the intruder detecting system is switched in operation with the detection area no longer crowded with people.

In view of the above, the security sensor equipped with a disturbance detector for detecting the presence or absence of the obstacle has been well known in the art and is disclosed in, for example, the Japanese Laid-open Patent Publication No. 2-287278. According to this publication, the disturbance detector used in the security sensor includes a light projecting element and a light receiving element and is so configured that while an obstacle detecting light emitted from the light projecting element is projected towards an inner surface of a lens, which forms a part of the light receiving enclosure of the security sensor and through which far infrared rays of light emitted from a human body pass onto a far infrared sensor element, the light receiving element may receive the obstacle detecting light reflected from the inner surface of the lens. In this structure, in the event that the obstacle is affixed to an outer surface of the lens, the obstacle detecting light reflected form the inner surface of the lens and traveling towards the light receiving element apparently contains a component of light reflected from the obstacle and, therefore, the amount of light incident on the light receiving element is higher when the obstacle is affixed to the outer surface of the lens than that when no obstacle is affixed thereto. By detecting an increase in amount of the light incident on the light receiving element relative to the standard amount of light normally received by the same light receiving element, the disturbance detector can detect the presence of the obstacle on the outer surface of the lens.

It has, however, been found that with the disturbance detector used in the prior art security sensor, detection of the increment of the light reflected from the obstacle is difficult to achieve where the amount of the obstacle detecting light reflected from the obstacle is insufficiently small relative to the standard amount of the light incident on the light receiving element because the obstacle detecting light reflected from the inner surface of the lens may travel astray.

In particular, in the event that the obstacle such as, for example, a transparent sticker of a kind capable of intercepting far infrared rays of light, but transmitting therethrough the obstacle detecting light of a wavelength ranging from a near infrared wavelength region to a visible wavelength region is tightly affixed to a front surface of the lens, the lens and the transparent sticker are integrated together and, hence, the amount of light reflected from the obstacle decreases so extremely that the disturbance detector may fail to detect it. Moreover, since the transparent sticker is virtually indiscernilde with eyes, the presence or absence of the obstacle on the lens is not easy to detect with eyes.

In order to detect the presence of the obstacle such as the transparent sticker of the kind discussed above, attempts have hitherto been made to capture an instantaneous change of the amount of the obstacle detecting light when the obstacle is affixed (i.e., to detect the act of affixing the obstacle) or to employ an increased emitting and receiving power of the disturbance detector. However, the former does not only require the disturbance detector to be activated at all times, but also is susceptible to an erroneous detection resulting from an erroneous operation of the disturbance detector. On the other hand, the latter may often result in an erroneous detection even when small insects traverse.

SUMMARY OF THE INVENTION

Accordingly, the present invention has been devised to substantially alleviate the foregoing problems inherent in the prior art security sensors and is intended to provide an improved security sensor having a disturbance detecting capability capable of easily detecting the presence of an obstacle such as, for example, a transparent sticker or label when the latter is affixed to a front surface of the light receiving enclosure of the security sensor.

In order to accomplish the foregoing object of the present invention, there is provided a security sensor having a disturbance detecting capability which includes a carrier body having an infrared sensor element; an incident side enclosure mounted on the carrier body, said incident side enclosure comprising a lens that defines at least one detection area for the infrared sensor element or a cover that covers an incident surface area of the infrared sensor element; a light projecting element for projecting a disturbance detecting beam from inside of the incident side enclosure towards the incident side enclosure; a light receiving element for receiving at least a portion of the disturbance detecting beam from the incident side enclosure; and a detecting circuit for detecting a presence or absence of an obstacle, applied to the incident side enclosure, based on an amount of light received by the light receiving element. A multiplicity of projections are formed on an outer surface of the incident side enclosure so as to define a multiplicity of gaps between the obstacle and the outer surface of the incident side enclosure, when the obstacle is applied to the outer surface of the incident side enclosure.

According to the present invention, even though the obstacle such as, for example, the transparent sticker of a kind capable of intercepting the far infrared light, but allowing the disturbance detecting beam to pass therethrough is applied to the outer surface of the incident side enclosure, the presence of the projections on the outer surface of the incident side enclosure does not allow the transparent obstacle to tightly adhere to the outer surface of the incident side enclosure, leaving gaps between the outer surface of the incident side enclosure and the obstacle. Accordingly, the amount of the disturbance detecting beam reflected from the inner surface of the obstacle increases and, hence, the amount of the light incident on the light receiving element increases correspondingly. The detecting circuit assuredly detects, by detecting the increase of the amount of the reflected light, the presence of the obstacle. Also, even though a small obstacle such as a fly or an insect perches temporarily on the outer surface of the incident side enclosure, and since the amount of the light reflected from such small obstacle is small, there is no possibility of the security sensor functioning erroneously.

In a preferred embodiment of the present invention, the use is made of a light guide member for guiding the disturbance detecting beam reflected from the obstacle towards the light receiving element. Since this light guide member guides the disturbance detecting beams, which has been reflected from the obstacle, so as to travel towards the light receiving element, the freedom of positioning the light receiving element can increase.

Also, preferably, the light guide member is positioned at a location offset from an incident area aligned with the infrared sensor element. Positioning of the light guide member in this manner will not cause the presence of the light guide member to reduce the disturbance detecting capability of the security sensor.

In a preferred embodiment of the present invention, the infrared sensor element and the light projecting elements are mounted on a printed circuit board. This enables a wiring circuit to be simplified.

Also, the incident side enclosure may include a lens having an inner surface formed with a Fresnel lens having rugged lens elements each having a step, in which case the projections are positioned on an outer surface of the lens at respective locations aligned with the steps of the rugged lens elements of the Fresnel lens. According to this design, although the steps correspond in position to a space between the neighboring detection areas defined by the lens elements, the presence of the projections at such portion will not distort the detection areas.

Again in a preferred embodiment of the present invention, the carrier body includes a base for supporting the infrared sensor element, the light projecting element and the light receiving element mounted thereon, and a casing fitted to the base; wherein a lens which is the incident side enclosure is fitted to the casing. The carrier body and the lens cooperate to enclose the infrared sensor element, the light projecting element and the light receiving element while the projections are formed on a center portion of the lens. According to this design, since the projections are positioned where the obstacle is likely to be applied, any act of fooling or tampering with the lens of the security sensor can effectively be prevented.

Yet, the carrier body may alternatively include a base for supporting the infrared sensor element, the light projecting element and the light receiving element mounted thereon, and a cover which is the incident side enclosure and which is fitted to the base so as to enclose the infrared sensor element, the light projecting element and the light receiving element, and wherein the projections are formed on a portion of the cover encompassed in and within the detection area. According to this design, any act of fooling or tampering with the cover of the security sensor with no lens can effectively be prevented.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENTS

Hereinafter, preferred embodiments of the present invention will be described with reference to the accompanying drawings.

Figure 1:
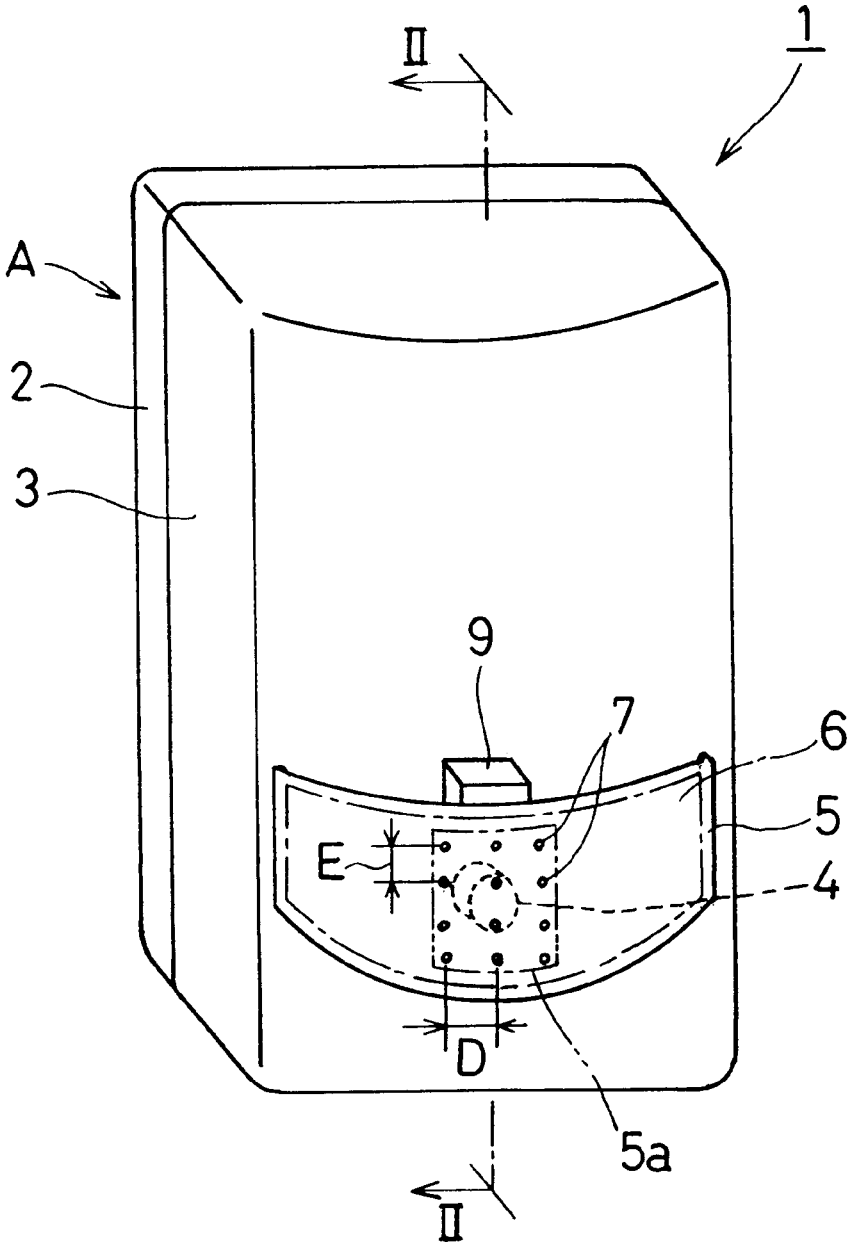
FIG. 1 is a perspective view of a security sensor having a disturbance detecting capability according to a first preferred embodiment of the present invention.

FIG. 1 illustrates a perspective view of a security sensor according to a first preferred embodiment of the present invention. This security sensor 1 includes a generally rectangular box-like carrier body A made up of a generally rectangular base 2 adapted to be fitted to a support surface such as, for example, a ceiling or a wall, and a cap-like cover casing 3 fitted to the base 2 for covering a front surface region of the base 2, and a pyroelectric element which is a passive-type far infrared sensing element and which is accommodated within the carrier body A. The casing 3 is detachably secured to the base 2 by means of a plurality of fitting screws (not shown).

Figure 2A:
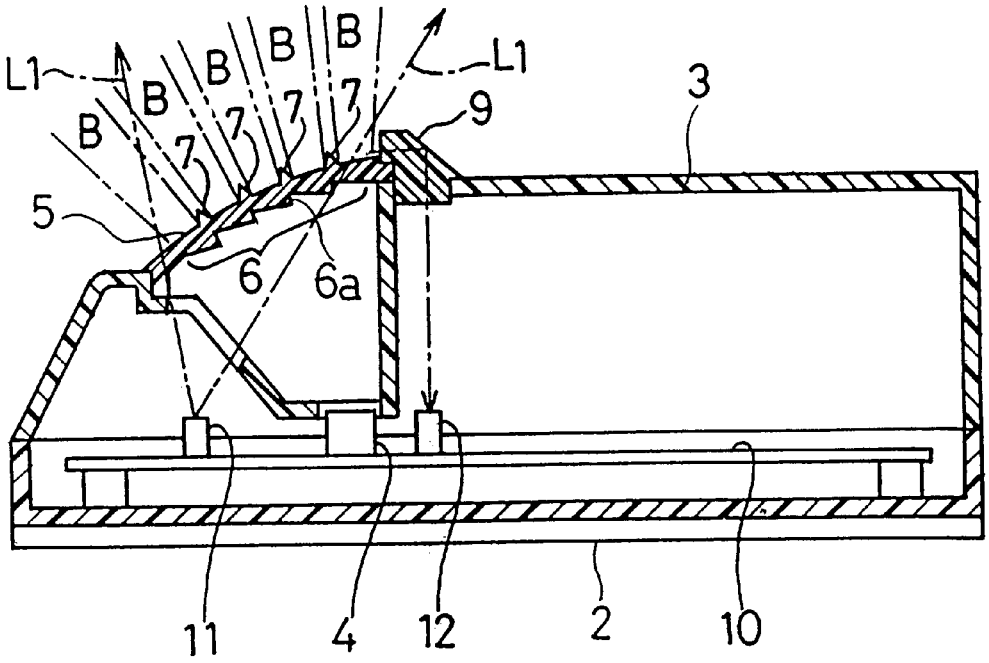
FIG. 2A is a cross-sectional view taken along the line II—II in FIG. 1.

As shown in FIG. 2A, the casing 3 made up of top and side walls has a generally rectangular opening in which a lens 5 serving as an incident side enclosure is fitted. This lens 5 concurrently serves as a protective covering for protecting the pyroelectric element 4 and is made of a synthetic resin such as, for example, polyethylene of a kind capable of transmitting far infrared rays of light therethrough. The lens 5 has an inner surface formed with a Fresnel lens section 6, which section 6 defines a plurality of detection areas B for the pyroelectric element 4. The Fresnel lens section 6 is made up of a plurality of rugged lens elements each having a step defined at 6*a*. A plurality of projections 7 each protruding a distance within the range of 1 to 3 mm outwardly from an outer surface of the lens 5 are formed on the outer surface of the lens 5 along respective lines corresponding to the steps 6*a* of the neighboring rugged lens elements and spaced a distance D of 5 to 15 min from each other as shown in FIG. 1. Since each of the steps 6*a* in the rugged lens elements corresponds to a space between the neighboring detection areas B, there is no possibility that the projections 7 positioned in alignment with the associated steps 6*a* may distort the respective detection areas B. A spacing E between neighboring lines corresponding to the associated steps 6*a* is within the range of 3 to 10 mm. Although the projections 7 so formed are positioned only where an obstacle is likely to be applied, for example, a center portion 5*a* of the lens 5, they may be formed over the entire outer surface of the lens 5.

A printed circuit board 10 fitted to the base 2 and positioned within the carrier body A has mounted thereon the pyroelectric element 4, a light projecting element 11 for generating a near infrared light, which is a disturbance detecting beam L1, so as to be projected from inside of the lens 5 towards the lens 5 and a light receiving element 12. In this way, the pyroelectric element 4, the light projecting element 11 and the light receiving element 12 are supported on and by the base 2 and are covered by the casing 3 and the lens 5 so as to be accommodated within the carrier body A. Also, a light guide member 9 for guiding towards the light receiving element 12 a portion of the disturbance detecting beam L1 which has been reflected from an obstacle 8 is disposed at a location outside the area occupied by the Fresnel lens section 6 of the lens 5. Accordingly, the light receiving element 12 can receive the reflected light component of the disturbance detecting beam L1 through the light guide member 9. In the illustrated embodiment, the light guide member 9 has a front incident portion defined therein and is fixedly inserted in a portion of the cover 3 adjacent the lens 5 with the front incident portion resting on an outer face of an edge portion of the lens 5.

The pyroelectric element 4 when detecting through the lens 5 far infrared rays of light emitted from a human body within the detection areas B detects that the human body has intruded the detection areas B. The light projecting element 11 when driven by a drive circuit 13 shown in FIG. 3 emits the disturbance detecting beam L1 towards a major portion at the center of the lens 5. Where no obstacle is applied to the outer surface of the lens 5, this disturbance detecting beam L1 transmits through the lens 5 with most of it traveling forwards (or upwardly as viewed in the drawing), but a portion of the transmitted disturbance detecting beam L1 enters an incident face 9*a* of the light guide member 9 so as to travel through the light guide member 9 towards the light receiving element 12 after having been reflected by a reflecting face 9*b* within the light guide member 9. At this time, an output voltage V from an incident light amount detecting circuit 14 for detecting the amount of light (reference incident light amount) received by the light receiving element 12 represents a substantially value V0 of a low level as shown in FIG. 4.

Figure 3:
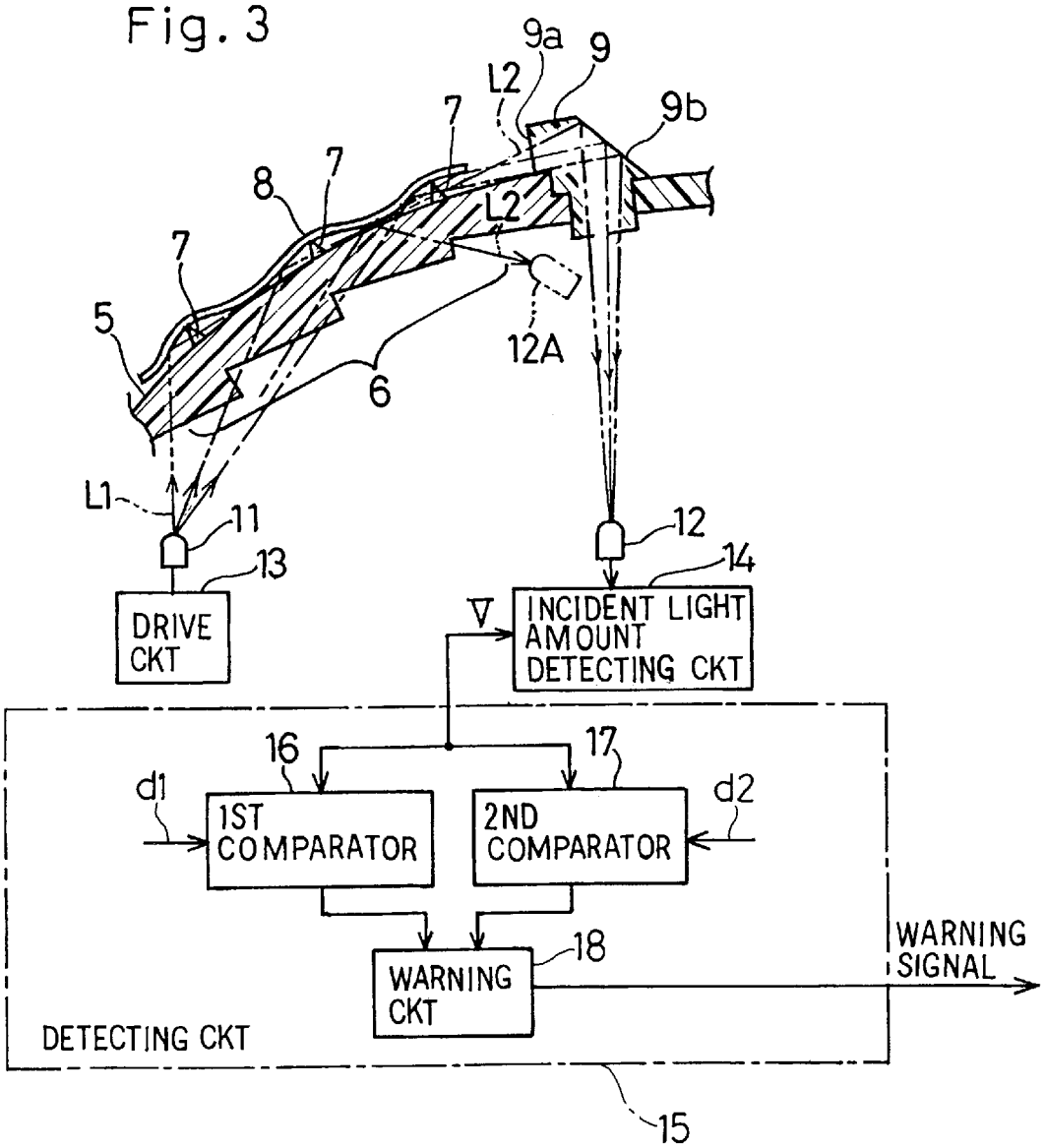
FIG. 3 is a block diagram showing an electric circuit of the disturbance detecting capability shown together with the manner in which light travels through a light guide member.
Figure 4:
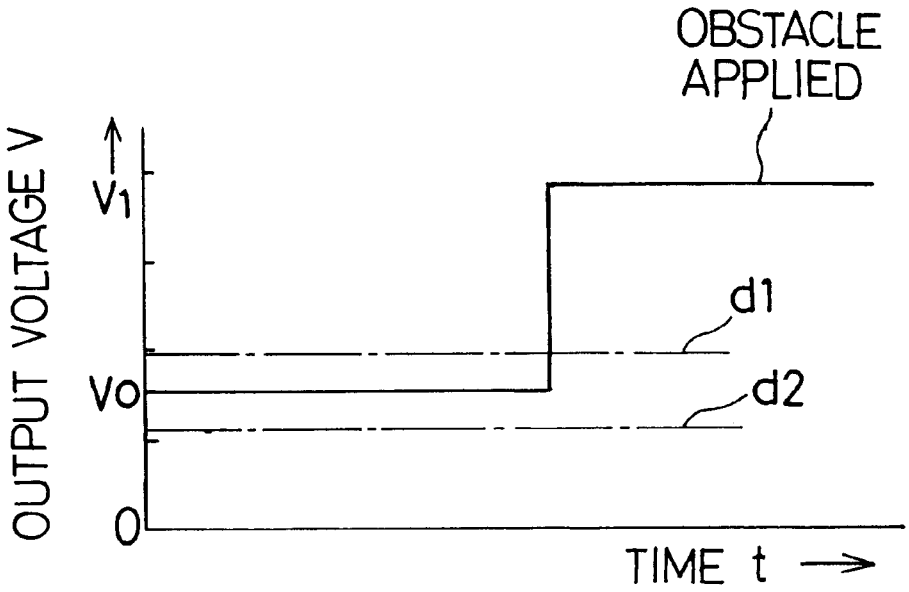
FIG. 4 is a chart showing an output voltage characteristic of an incident light amount detecting circuit used in the first preferred embodiment of the present invention.

However, where the obstacle 8 such as, for example, a transparent sticker of a kind capable of intercepting far infrared rays of light, but allowing light ranging from a near infrared wavelength region to a visible wavelength region to pass therethrough is applied to the outer surface of the lens 5 as shown in FIG. 3, the obstacle 8 so applied does, in view of the presence of the projections 7 on the outer surface of the lens 5, represent a wavy shape partly separating from the outer surface of the lens 5 and partly resting or bonded to respective tips of the projections 7. Accordingly, the disturbance detecting L1 projected from the light projecting element 11 is reflected by an inner surface of the obstacle 8 with a portion thereof entering the incident face 9*a* of the light guide member 9 so as to travel through the light guide member 9 and finally received by the light receiving element 12 after having been reflected by the reflecting face 9*b* within the light guide member 9. As a result, the output voltage V from the incident light amount detecting circuit 14 for detecting the amount of light received by the light receiving element 12 increases to a high level V1 as shown in FIG. 4.

A detecting circuit 15 shown in FIG. 3 includes first and second comparators 16 and 17 and a warning circuit 18. An output voltage V from the incident light amount detecting circuit 14 is supplied to the first and second comparators 16 and 17 so that the output voltage V can be compared by the first comparator 16 with a first threshold value d1 and also by the second comparator 17 with a second threshold value d2. By way of example, the first threshold value d1 for the first comparator 16 is chosen to be a value that is about 1.1 times the low level voltage V0 outputted from the incident light amount detecting circuit 14 when no obstacle is applied to the lens 5, whereas the second threshold value d2 for the second comparator 17 is chosen to be a value that is about 0.9 times the low level voltage V0 when no obstacle is applied to the lens 5.

The first comparator 16 compares the input voltage V with the first threshold value d1 and outputs a disturbance detection signal to the warning circuit 18 when the input voltage V is higher than the first threshold value d1. The warning circuit 18 then operates in response to the disturbance detection signal from the first comparator 16 to provide a control room (not shown) with a warning signal. In this way, in the event that the obstacle such as a transparent sticker of the kind capable of intercepting far infrared rays of light, but allowing light ranging from a visible wavelength region to a near infrared wavelength region to pass therethrough is applied externally to the outer surface of the lens 5, the amount of light incident on the light receiving element 12 increases and the warning signal is provided by detecting such a change in amount of light received by the light receiving element 12. Accordingly, it is possible to detect the presence of the transparent sticker purposefully applied to the lens 5 to fool or tamper the security sensor.

On the other hand, where as an obstacle a black-colored sticker or paint is applied externally to the lens 5, the disturbance detecting beam L1 may be absorbed by the obstacle and, consequently, the amount of light incident on the light receiving element 12 through the light guide member 9 decreases. The second comparator 17 compares the input voltage V from the incident light amount detecting circuit 14 with the second threshold value d2 and outputs a disturbance detection signal to the warning circuit 18 when the input voltage V is lower than the second threshold value d2. Accordingly, the warning circuit 18 similarly operates in response to the disturbance detection signal from the second comparator 17 to provide the control room with the warning signal.

According to the present invention now under discussion, since the light receiving element 12 receives the light guided through the light guide member 9, the light receiving element 12 can be at any desired location spaced a distance from- the position of the lens 5. In the illustrated embodiment, the light receiving element 12 is positioned on the circuit board 10 as the light receiving element 12 can readily and easily be supported. Also, in the event that the obstacle is, for example, a fly or an insect perching temporarily on the outer surface of the lens 5, the amount of the disturbance detecting beam reflected from such object is extremely small and, therefore, the security sensor 1 will not operate erroneously.

It is to be noted that according to a broad aspect of the present invention the use of the light guide member 9 may not be always essential and may therefore be dispensed with. In such case, the light receiving element may be positioned in the vicinity of an inner surface of the lens 5 as shown by the phantom line 12A in FIG. 3 so that the disturbance detecting beam reflected from the obstacle 8 can be assuredly received by the light receiving element 12A.

Figure 2B:
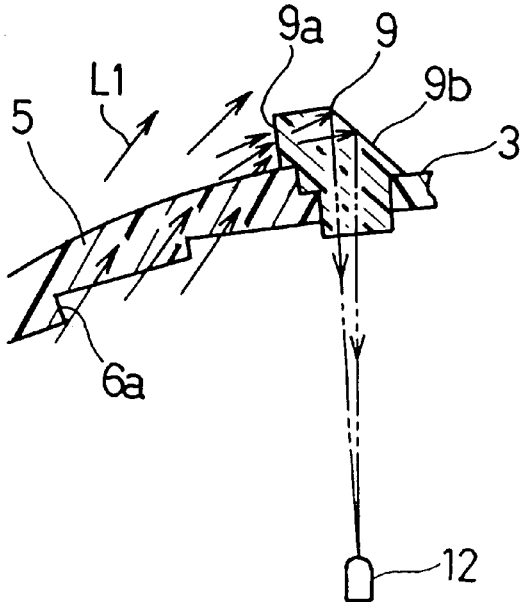
FIG. 2B is a sectional view, on an enlarged scale, showing a lens portion of the security sensor shown in FIG. 1.
Figure 5:
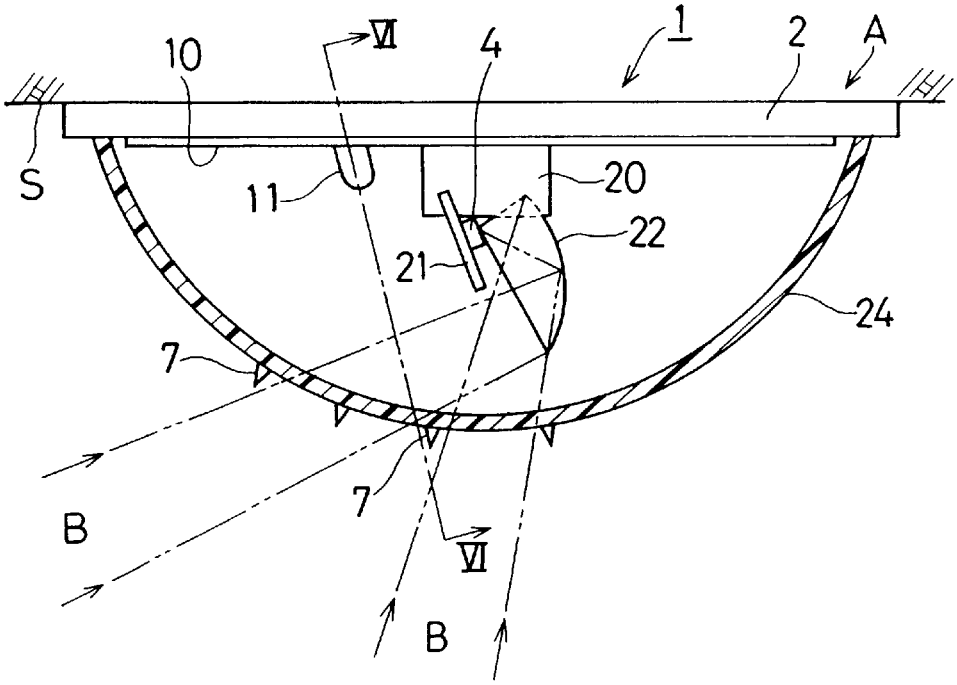
FIG. 5 is a sectional view of the security sensor according to a second preferred embodiment of the present invention.
Figure 6:
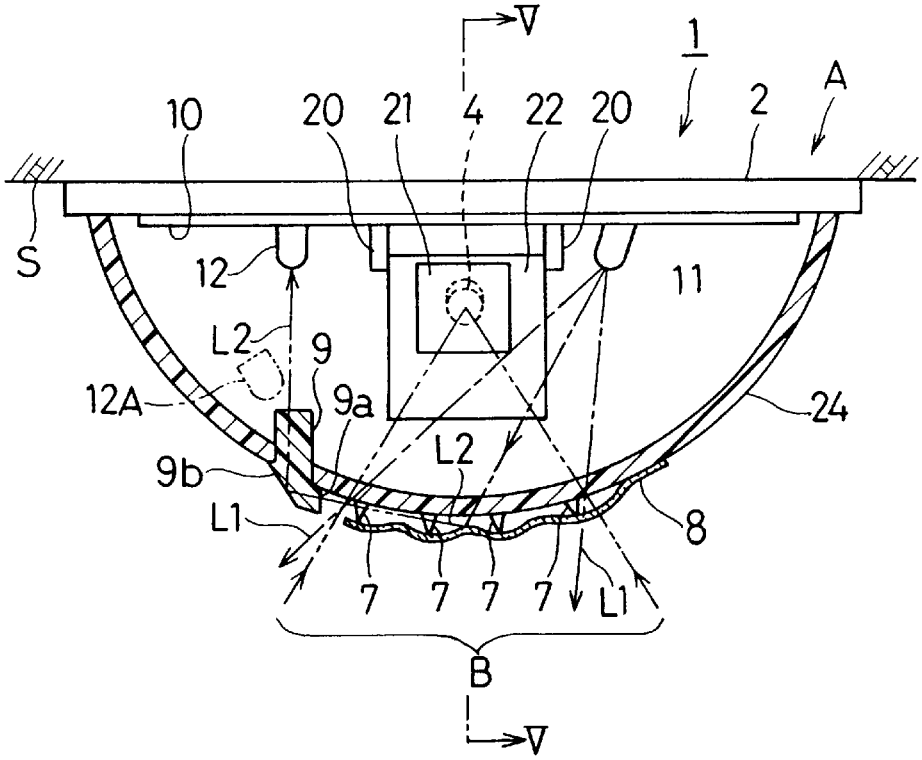
FIG. 6 is a cross-sectional view taken along the line VI—VI in FIG. 5.

FIGS. 5 and 6 illustrate the security sensor according to an alternative embodiment of the present invention, wherein FIG. 5 represents the cross-sectional view taken along the line V—V in FIG. 6 and FIG. 6 represents the cross-sectional view taken along the line VI—VI in FIG. 5. Component parts which are shown in FIGS. 5 and 6, but are similar to those shown in FIGS. 1 to 3 are identified by like reference numerals used in FIGS. 1 to 3.

The security sensor 1 similarly includes a box-like carrier body A made up of a generally rectangular base 2 adapted to be fitted to a support such as, for example, a ceiling S. A printed circuit board 10 is fitted to the base 2 and includes support members 20 and 20 mounted thereon. A carrier substrate 21 is adjustably supported by the support members 20 and 20 for rotation about an axis connecting between the support members 20 and 20 and has a pyroelectric element 4 and a polygon mirror 22 mounted on the carrier substrate 21 so as to define a plurality of detection areas B. A semispherical cover (incident side enclosure) 24 made of an opaque synthetic resin is capped onto the base 2 so as to enclose incident surface areas of the pyroelectric element 4 and polygon mirror 22. A plurality of projections 7 are formed on the outer surface of the semispherical cover 24 in a position encompassing the detection areas B, that is, an incident area of the pyroelectric element 4 and its vicinity. Although as is the case with the embodiment particularly shown in FIG. 1, these projections 7 are formed only a center portion of the semispherical cover 24 where the obstacle is likely to be applied, they may be formed over the entire outer surface of the semispherical cover 24. The semispherical cover 24 employed in the practice of the alternative embodiment of the present invention is an incident side enclosure that merely serves to protect the sensor carrier body A and has no lens capability that defines the detection areas.

A light guide member 9 is secured to the semispherical cover 24 while extending across the thickness of the semispherical cover 24, at a location offset from an incident path through which external light is incident upon the pyroelectric element 4. The light projecting and receiving elements 11 and 12 are fixedly mounted on the printed circuit board 10. Thus, the pyroelectric element 4 and the light projecting and receiving elements 11 and 12 are supported by the base 2 forming a part of the sensor carrier body A and are encased by the semispherical cover 24 fitted to the base 2. The light projecting element 11 is electrically connected with the drive circuit 13 shown in FIG. 3 whereas the light receiving element 12 is electrically connected with the incident light amount detecting circuit 14 and the detecting circuit 15 both also shown in FIG. 3.

The security sensor 1 according to the alternative embodiment shown in FIGS. 5 and 6 is so designed and so configured that, as shown in FIG. 6, in the event that the obstacle 8 such as a transparent sticker for disturbing the capability of the pyroelectric element 4 is applied to an outer surface area of the semispherical cover 24 that is encompassed within one or more detection areas B, the near infrared light projected from the light projecting element 11 can be reflected from an inner surface of the transparent sticker 8 so as to travel towards the light receiving element 12. Accordingly, as is the case with the security sensor 1 according to the previously described embodiment, when the light reflected from the obstacle 8 falls on the light receiving element 12, the output voltage V from the incident light amount detecting circuit 14 increases shown in FIG. 3 and the warning signal is outputted with the detecting circuit 15 having detected the presence of the obstacle 8 in a manner similar to that described in connection with the previously described embodiment. On the other hand, in the event that a black-colored sticker or paint as the obstacle 8 is applied to the semispherical cover 24 as shown in FIG. 6, the disturbance detecting beam L1 may be absorbed by the obstacle 8 and, consequently, the output voltage V from the incident amount detecting circuit 14 shown in FIG. 3 decreases and the warning signal is outputted with the detecting circuit 15 having detected the presence of the obstacle 8 in a manner similar to that described in connection with the previously described embodiment.

It is to be noted that even in the alternative embodiment shown in FIGS. 5 and 6 the use of the light guide member 9 may not be always essential and may therefore be dispensed with. In such case, the light receiving element may be positioned in the vicinity of an inner surface of the lens 5 as shown by the phantom line 12A in FIG. 6 so that the disturbance detecting beam reflected from the obstacle 8 can be assuredly received by the light receiving element 12.

In any one of the foregoing embodiments of the present invention the disturbance detecting beam L1 has been described as near infrared light. However, where the lens 5 or the cover 24 is made of a transparent material, light of a visible wavelength region can be used for the disturbance detecting beam L1.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the scope of the present invention as delivered from the claims annexed hereto, to be construed as included therein.

What is claimed is:

1. A security sensor having a disturbance detecting capability, which comprises:

a carrier body having an infrared sensor element;

an incident side enclosure mounted on the carrier body, said incident side enclosure comprising a lens that defines at least one detection area for the infrared sensor element;

a light projecting element for projecting a disturbance detecting beam from inside of the incident side enclosure towards an inner surface of the detection area of said incident side enclosure;

a light receiving element for receiving at least a portion of the disturbance detecting beam reflected from the incident side enclosure;

a detecting circuit for detecting a presence or absence of an obstacle, applied to the incident side enclosure, based on an amount of light received by the light receiving element; and a multiplicity of projections integrally formed and spaced apart on an outer surface of the incident side enclosure and positioned in an incident area aligned with the infrared sensor element so as to define a multiplicity of gaps between the obstacle and the outer surface of the incident side enclosure, when the obstacle is applied to the outer surface of the incident side enclosure.

2. The security sensor as claimed in claim 1, further comprising a light guide member for guiding the disturbance detecting beam reflected from the obstacle towards the light receiving element.

3. The security sensor as claimed in claim 2, wherein said light guide member is positioned at a location offset from the incident area aligned with the infrared sensor element.

4. The security sensor as claimed in claim 1, wherein the carrier body includes a printed circuit board, said infrared sensor element and said light projecting elements being mounted on the printed circuit board.

5. The security sensor as claimed in claim 1, wherein said incident side enclosure comprises a lens having an inner surface formed with a Fresnel lens having rugged lens elements each having a step and wherein the projections are positioned on an outer surface of the lens at respective locations aligned with the steps of the rugged lens elements of the Fresnel lens.

6. The security sensor as claimed in claim 1, wherein said carrier body comprises a base for supporting the infrared sensor element, the light projecting element and the light receiving element mounted thereon, and a casing fitted to the base; wherein the lens is fitted to the casing, said carrier body and said lens cooperating to enclose the infrared sensor element, the light projecting element and the light receiving element; and wherein the projections are formed on a center portion of the lens.

7. A security sensor having a disturbance detecting capability, which comprises:

a carrier body having an infrared sensor element;

an incident side enclosure mounted on the carrier body, said incident side enclosure comprising a cover that covers an incident surface area of the infrared sensor element;

a projecting element for projecting a disturbance detecting beam from inside of the incident side enclosure towards an inner surface of the detection area of the incident side enclosure;

a receiving element for receiving at least a portion of the disturbance detecting beam reflected from the incident side enclosure;

a detecting circuit for detecting a presence or absence of an obstacle, applied to the incident side enclosure, based on an amount of detecting beam received by the receiving element; and a multiplicity of projections integrally formed on and extending from an outer surface of the incident side enclosure, the projections are positioned in an incident area aligned with the infrared sensor element and spaced apart from each other so as to define a multiplicity of gaps between any obstacle and the outer surface of the incident side enclosure, when the obstacle is applied to the outer surface of the incident side enclosure.

8. The security sensor as claimed in claim 7, further comprising a guide member for guiding the disturbance detecting beam reflected from the obstacle towards the receiving element.

9. The security sensor as claimed in claim 8, wherein said guide member is positioned at a location offset from an incident area aligned with the infrared sensor element.

10. The security sensor as claimed in claim 7, wherein the carrier body includes a printed circuit board, said infrared sensor element and said projecting element being mounted on the printed circuit board.

11. The security sensor as claimed in claim 7, wherein the carrier body comprises a base for supporting the sensor element, the projecting element and the receiving element mounted thereon, and the cover is fitted to the base so as to enclose the sensor element, the projecting element and the receiving element.

12. A security sensor system comprising:

a detector element for detecting infrared radiation representative of an intruder in a target area;

a cover member extending over the detector element and having an incident surface transmissive of the infrared radiation from the target area;

a plurality of projections formed on and extending outward from the incident surface of the cover member, while permitting the infrared radiation to pass between the projections to contact the detector element;

a source of a disturbance detecting beam directed at an interior surface of the cover member having the projections; and a disturbance detecting beam detector unit positioned under the cover member to receive a portion of the disturbance detecting beam that will vary depending upon a presence of any obstacle placed over the plurality of projections on the incident surface whereby the plurality of projections will provide gaps between any obstacle and the adjacent incident surface of the cover member to reflect the disturbance detecting beam toward the disturbance detecting beam detector, wherein the cover member includes a Fresnel lens having lens elements each having a step and wherein the projections are positioned at respective locations in alignment with the steps of the lens elements.

13. The security sensor system of claim 12 wherein the cover member includes a Fresnel lens having lens elements each having a step and wherein the projections are positioned at respective locations in alignment with the steps of the lens elements.

* * * * *